United States Patent [19]

Switall et al.

[11] Patent Number: 4,649,818

[45] Date of Patent: Mar. 17, 1987

[54] VARIABLE FREQUENCY PULSED SPRAY DAMPENING SYSTEM

[75] Inventors: Thomas G. Switall, Kildeer; Michael Schaefges, Wheeling; Alan Goetzelman, Prospect Heights, all of Ill.

[73] Assignee: Ryco Graphic Manufacturing, Inc., Wheeling, Ill.

[21] Appl. No.: 870,657

[22] Filed: Jun. 2, 1986

Related U.S. Application Data

[63] Continuation of Ser. No. 757,193, Jul. 22, 1985, which is a continuation of Ser. No. 518,470, Jul. 29, 1983.

[51] Int. Cl.[4] ..... B41F 7/30; B41L 25/06

[52] U.S. Cl. ..... 101/147

[58] Field of Search ..... 101/148, 147, 366; 118/696, 699, 300, 259; 239/550

[56] References Cited

U.S. PATENT DOCUMENTS

| | | | |
|---|---|---|---|
| 3,134,326 | 5/1964 | Davis | 101/366 |
| 3,651,756 | 3/1972 | Smith, Jr. | 101/366 X |
| 4,064,801 | 12/1977 | Switall | 101/147 |
| 4,395,667 | 7/1983 | Tonn | 318/309 |
| 4,469,024 | 9/1984 | Schwartz et al. | 101/366 X |

*Primary Examiner*—J. Reed Fisher

*Attorney, Agent, or Firm*—Lee, Smith & Zickert

[57] ABSTRACT

A spray dampening control system for use in a planographic printing operation includes solenoid-operated spray dampening fluid nozzles operated at a frequency in accordance with the speed of the press. The press speed is measured and converted in a nonlinear relationship into a frequency applied to the solenoid-operated spray nozzles. Individual nozzle control circuits are provided for further controlling the nozzle pulse characteristics by varying the width of the frequency pulses independently of the frequency. Auxiliary frequency generators are provided for substitution of the primary multifrequency generator, and isolation means between circuit stages are provided for ease of replacement and maintenance.

30 Claims, 12 Drawing Figures

P/O MULTI-FREQ. PULSE GEN.
FREQ. No. 1
FREQ. No. 2
VCC
R20
R22
C8
R24
R26
C10

VARIABLE FREQUENCY PULSED SPRAY DAMPENING SYSTEM

This application is a continuation of application Ser. No. 757,193, filed July 22, 1985, now abandoned, which is a continuation of application Ser. no. 518,470, filed July 29, 1983, now abandoned.

BACKGROUND OF THE INVENTION

The present invention relates in general to a system for controlling the application of a solution to printing press rollers, and more particularly, to improved methods and apparatus for applying a wetting solution in the form of a pulsating spray, and controlling the amount of solution sprayed in accordance with the speed of the printing press.

By the nature of the planographic printing processes, including offset and photolithography, an application of a wetting solution and ink are applied to inking rollers and the ink is then transferred to the paper medium. The wetting solution is applied to the roller including the portion representing the absence of printed information. The wetting solution is basically water along with other additives. According to current offset printing methods, the ink is of an oil base composition, and a viscosity which repels the water base solution. In conventional planographic printing techniques the ink adheres to the photoengraved portion of the plate, and is repelled by the blank portion. Also, the wetting solution adheres to the blank portion, or nonphotoengraved part of the plate, and thus further prevents the application of ink, especially excess ink, on the blank areas of the planographic plate.

The transfer of the ink and wetting solution to the rotating photoengraved plate is accomplished by causing such plate to contact a rotating inking roller which has deposited or sprayed on it a first coating of ink, followed by a second outer coating consisting of the wetting solution.

Control of the amount of wetting solution on the inking roller is crucial for several reasons. If insufficient wetting solution is applied to the roller the ink tends to migrate onto the blank portion of the plate and thereby be transferred to corresponding areas of the paper which are not to be printed. Secondly, if an excess amount of wetting solution is applied to the roller, such excess represents waste which must be collected and removed from the system.

The problem of accurately applying a wetting solution in planographic printing processes has been addressed before, and has to a certain degree succeeded. However, with the speed and efficiency at which printing systems currently operate, the shortcoming of these traditional techniques cannot be tolerated.

One type of spray system described in U.S. Pat. No. 3,937,175 by Horner employs a solenoid controlled valve in the fluid supply line to intermittently supply fluid in a pulsed manner to spray nozzles. The solenoid is electrically controlled by a timer to open the valve when the system pressure is at a maximum to thereby achieve a forceful jet of spray. This system suffers a shortcoming insofar as it does not take into account the speed of the press via-a-vis the amount of spray discharged.

A more sophisticated spray dampening system is disclosed in U.S. Pat. No. 4,064,801, and assigned to the assignee of the present application. In this system the pressure of the dampening fluid is regulated in accordance with the speed of the press whereby a metered spray can be applied to the press rollers. Means are also provided for pulsing the spray nozzles open and closed, as well as for manual adjustment of the duty cycle and frequency of such pulses. The difficulty prevalent in these systems is that despite an attempt to very accurately gauge the spray pressure with press speed, the resultant spray is linearly related to press speed and thus at low speeds too little liquid is applied, and at high speeds too much liquid is applied.

More particularly, the spray dampening system disclosed in Pat. No. 4,064,801 is an air system, that is, the air carries the dampening fluid to the press rolls. The air is under a pressure of about 2 psi and the pressure of the liquid varies from 1 to 5 psi depending upon the press speed. Such a low pressure system has more tendency to clog than a high pressure airless system in which the nozzles are in effect "self cleaning".

In an airless sprayer, however, the pressure of the liquid governs the spray pattern angle and must remain constant. If it does not, the spray pattern angle will change causing variations in the coverage on the press roll.

It is therefore an object of this invention to provide an airless sprayer where the liquid pressure and thus the spray pattern angle or coverage of the rolls remains constant and there is greater control over, and increased uniformity in the application of the liquid.

It is a further object to provide an instantaneous shut off of liquid during each pulse cycle without perceptible variation in the spray pattern angle or coverage of the rolls.

It is also an object of the present invention to provide a pulsed spray dampening system where a liquid is supplied to spray nozzles at a constant pressure, but where such nozzles are automatically pulsed at frequencies corresponding to various press speeds.

It is another object of the present invention to provide a pulsed spray dampening system where the amount of spray liquid is nonlinearly related to the speed of the press such that at low and high press speeds the amount of liquid is respectively increased and decreased so as to optimize the process and minimize waste.

It is a corollary object of the present invention to provide a pulsed spray dampening system which automatically adjusts, according to a predetermined scheme, the liquid spray volume by adjusting the frequency by which the liquid is pulsed by the nozzles. It is yet another object of the invention to section the spray dampening system into major functional units and isolate each unit electrically to prevent electrical failures in one such unit from affecting another unit thereby enhancing maintenance, repairability and reliability of the system.

SUMMARY OF THE INVENTION

In accordance with the invention there is provided a control system for regulating the amount of liquid spray delivered to printing operation rollers in accordance with the general speed of the printing system.

Solenoid operated spray nozzles are arranged adjacent the printing rollers on which the liquid is to be applied. The spray nozzle solenoids are operated with respect to both frequency and duty cycle considerations by an electrical system which has as its input the speed of the printing press operation, and has as its output a predetermined frequency of pulses which are applied to the spray nozzle solenoids. In accordance with a predetermined scheme, the frequency with which the spray nozzles are electrically pulsed increases nonlinearly as the press speed increases. In the preferred embodiment of the invention there is provided manual means for controlling the duty cycle with which each spray nozzle is electrically pulsed.

Particularly, the control system employs an analog voltage which is linearly related to the press speed. A selector circuit, in conjunction with a multifrequency signal generator provides an output frequency based upon a voltage level corresponding to the present speed of the press. The relationship between the particular voltage levels and the output frequency selected is nonlinear in nature so as to provide a somewhat higher pulse frequency at low press speeds, and a somewhat lower frequency at high press speeds. A dot graph display provides a visual indication of the dynamic state of the spray system, and a numeric readout provides an operator with a visual indication of the frequency with which the solenoid spray nozzles are operated.

At start-up, or during low press speeds, a multivibrator circuit operating at a single higher-than-normal frequency, can be manually or automatically activated to override the output of the multifrequency generator to thereby increase the solenoid spray nozzle frequency and essentially flood the press roller with an excess amount of liquid. A start/drop-out circuit is responsive to low press speed at start-up and at shut-down to prevent any frequency pulses from being coupled to the solenoid-operated spray nozzles.

For reliability, the various functional blocks of the spray dampening control system are electrically coupled with optical isolators to prevent catastrophic electrical failures in certain stages from effecting other stages. In addition, in the event of an electrical failure in the primary control system, an auxiliary manually variable frequency generator can be activated to control the solenoid operated nozzles at a frequency selected by the operator.

While the invention has been shown and will be described with reference to specific, exemplary embodiments of methods and apparatus, there is no intention that it thus be limited to the particular aspects or details of such embodiments. On the contrary, it is intended here to cover all modifications, alternatives, equivalents and subcombinations which fall within the spirit and scope of the invention as defined in the appended claims.

DETAILED DESCRIPTION OF THE PREFERRED EMBODIMENT

It will be useful to set out generally the definition of certain terms employed throughout the description of the preferred embodiment.

The term "frequency" as used herein denotes the repetitive occurrence of electrical signals at predetermined recurrent periods of time.

The term "duty cycle" is used to connote the ratio of electrical pulse widths with respect to a frequency time period. It is therefore seen that an increase in the width of an electrical pulse, keeping the frequency constant, effectively increases the duty cycle of the stream of pulses.

The term "analog voltage", as distinguished from a quickly changing voltage, is intended to mean a voltage which changes in magnitude according to the speed of the press.

Figures 1, 4:
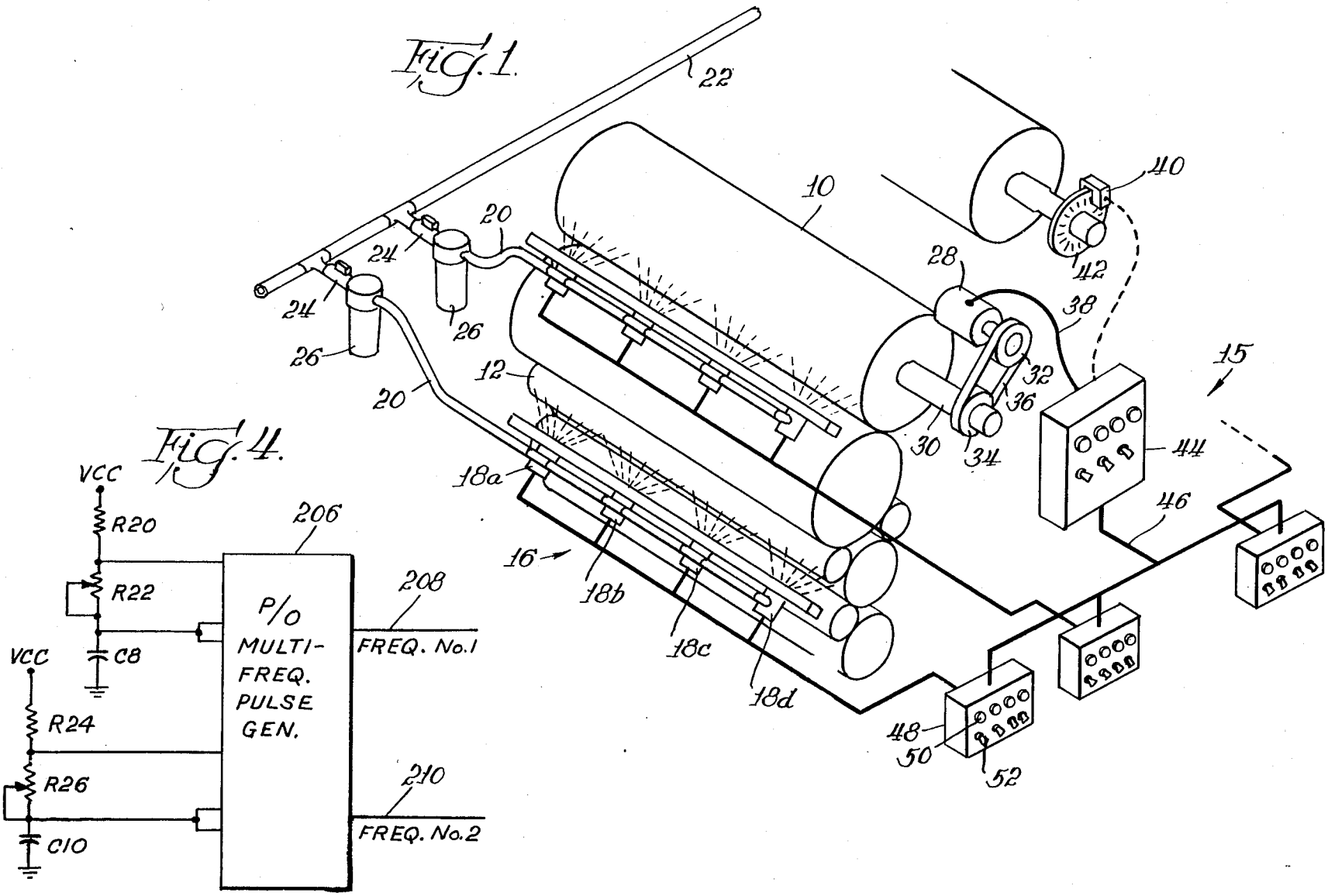
FIG. 1 is a generalized block diagram of a portion of an exemplary printing operation, illustrating by way of background the incorporation of the spray dampening control system embodying the present invention.
FIG. 4 is a simplified circuit diagram of a dual pulse frequency generator comprising a part of the multifrequency pulse generator.

Referring now to FIG. 1, there is shown a typical printing operation including various rollers such as a plate cylinder 10, and an inking roller 12 both rollers of which require the application of a dampening fluid to the surfaces thereof for the proper transfer of the photoengraved image on the plate cylinder 10 to the paper (not shown). While different printing operations may require fewer or more rollers than shown in FIG. 1, it is sufficient to realize that irrespective of the particular printing operation the application of spray dampening solution to roller surfaces is required to effect a proper transfer of ink from the offset plate cylinder to the paper medium. Other printing operations, such as folding machines, can advantageously utilize the principles of the present invention to facilitate the folding operation.

The spray dampening control system, generally designated 15, includes one or more solenoid-operated spray nozzle bars, one shown as reference character 16. In the exemplary printing operation, spray bar 16 includes four solenoid-operated spray nozzles 18*a*, 18*b*, 18*c*, 18*d*, spaced apart from each other and from the inking roller 12 such that the spray jet emitted from the nozzles uniformly covers the surface of such roller. For the sake of clarity the inking system for applying the oil base ink to the inking roller 12 is not shown. Each solenoid controlled spray nozzle, being of well-known and conventional design, has an input plumbed to a liquid supply line 20. The electrically controlled nozzles used with the present invention are of the normally off type where the application of an electrical signal opens the nozzle valve to allow the pressurized liquid to be sprayed for the duration of the signal. Electrically controlled nozzles of this type, being either fully on or off, provide a constant angle of spray when activated and thus maintain a constant area of coverage even though the volume of liquid sprayed may be reduced. With this arrangement the volume of liquid sprayed is increased either with an increase in frequency, or by an increase in the duration of the electrical signal.

A main liquid supply conduit 22 provides spray dampening fluid at a pressure of about 75–90 pounds to the supply lines 20 through respective shut off valves 24 and filters 26. In keeping with the invention, a conventional liquid pressure pump (not shown) supplies the spray dampening fluid to the spray bars 16 at a constant pressure without regard to the speed of the printing operation. In this manner expensive pressure regulating apparatus for varying the fluid pressure according to press speed is eliminated, along with the attendant maintenance problems.

In the preferred embodiment of the invention a measure of the speed of the printing operation is derived from a tachometer generator 28 which is coupled to shaft 30 of plate cylinder 10 by pulleys 32 and 34, and a drive belt 36. Tachometer generator 28 is of conventional design having an output voltage range of about 0–50 volts and varies linearly according to the angular velocity of the plate cylinder 10. With this arrangement the speed with which paper is printed, and thus processed through the printing operation, is in direct correspondence with the tachometer generator output. The output voltage of the generator 28 is coupled to the spray dampening control system 15 by electrical wires 38. Of course, the tachometer generator 28 can be conveniently coupled to other printing rollers to provide an indication of the printing operation speed. With the current demand for printed matter, and the desire to increase the output of printing operations without the costly purchase of additional presses, the speeds of printing presses are not surprisingly operating at maximum speeds of approximately 50,000–70,000 papers per hour.

As an option to the tachometer generator input to the spray dampening control system 15 a Hall effect proximity sensor 40 may be employed to sense the angular velocity of the roller shaft and produce a pulse train with a frequency representative of the angular velocity of the shaft. According to the operation of standard Hall effect proximity sensors the number of pulses per unit of time, and thus the frequency generated, is a function of the number of apertures angularly spaced around the wheel 42. An optical light source and detector may be used with equal advantage with the apertured wheel 42 to produce a pulse repetition rate representative of the printing press speed.

According to the invention the spray dampening control system 15 includes, together with the spray bars 16, a master control unit 44 for converting the analog voltage output of the tachometer generator 28, or the pulse frequency of the proximity sensor 40, into an output frequency on electrical bus 46.

A plurality of spray bar drivers, one shown at reference character 48, receive the master control output frequency on distribution bus 46 and drive the solenoids of the spray nozzles associated with the respective spray bar. Each spray bar driver 48 is capable of individually driving the four solenoid-operated spray nozzles 18*a–d* with a frequency as determined by the master control unit 44 and is thereby able to regulate the volume of liquid sprayed from each nozzle. As will be more fully discussed below, the solenoid of each spray nozzle is further controlled in each spray bar driver circuit 48 by controlling the duty cycle of the electrical pulse without affecting the frequency of such pulses as generated by the master control unit 44. In addition, each spray bar driver circuit 48 includes a switch 52 associated with each spray nozzle for deactivating the particular nozzle and removing it from service. It will also be explained more fully the manner in which each spray bar driver circuit is electrically isolated from each other, as well as from the master control unit 44 to prevent an electrical failure in one such unit from affecting other units.

Figure 2:
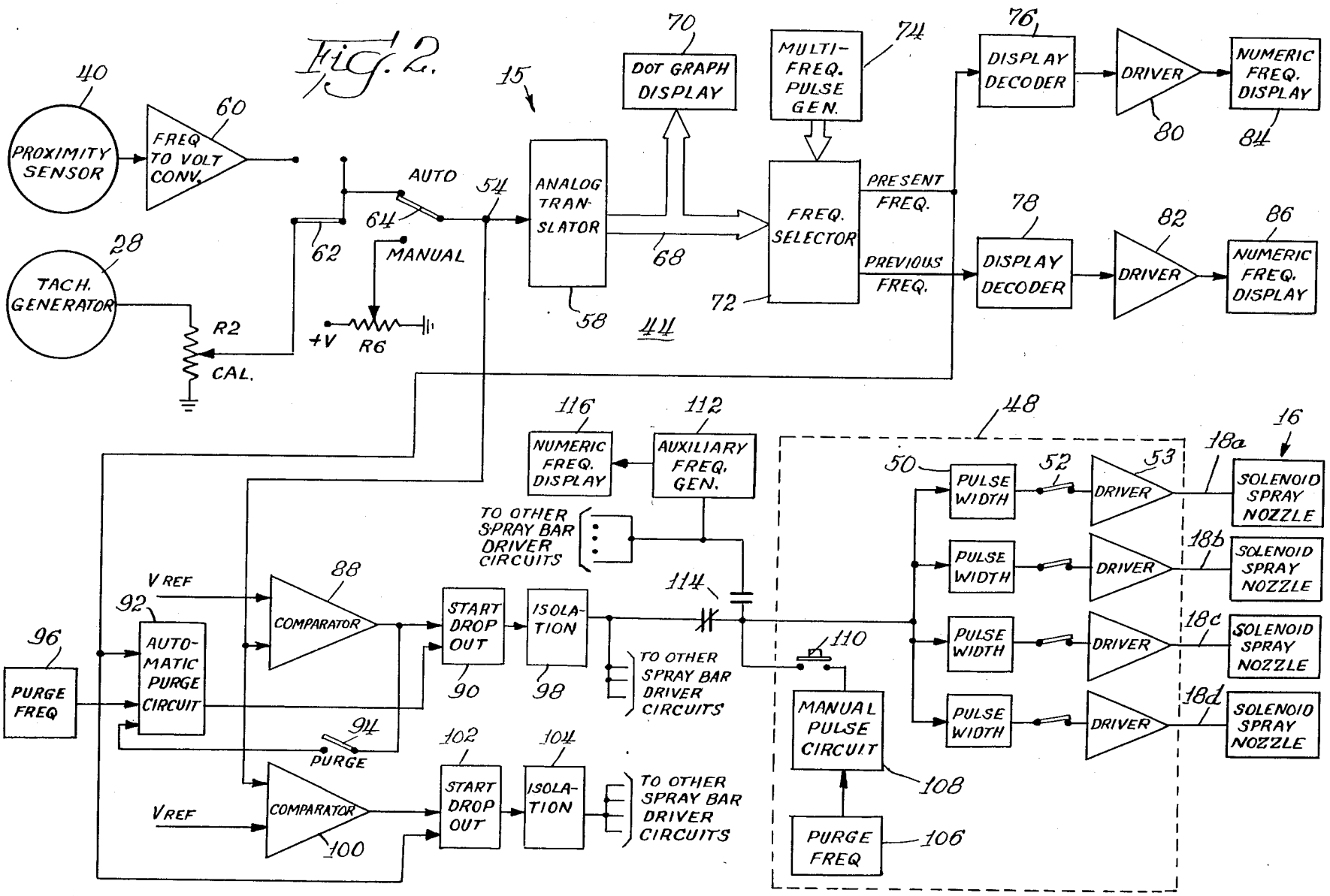
FIG. 2 is a more detailed block diagram illustrating the functional blocks constituting an exemplary preferred embodiment of the spray dampening control system which operates to carry out the methods of the present invention.

For an understanding of the functional blocks of the spray dampening control system reference should be had to FIG. 2 where the primary functions of the control system are depicted in block form. As an example of some of the devices which can be employed to produce an indication of the printing operation speed, FIG. 2 shows the use of a proximity sensor 40 and a tachometer generator 28. It should be understood that irrespective of the press speed sensor device selected, the objective is to provide to the master control circuit 44 an analog voltage at junction 54 which is linearly representative of the press speed. If a tachometer generator 28 is utilized, as in the preferred embodiment of the invention, a calibration potentiometer R2 is used to reduce the high 0–50 volt output of the generator 28 to a lower voltage range between 0 and 5 volts which is readily usable by the master control unit 44. The calibration potentiometer R2 does not disturb the linear relationship of the analog voltage with respect to the press speed. If, on the other hand, it is desired to use a proximity sensor 40, then the master control unit 44 is provided with a frequency-to-voltage converter 60 for converting the frequency of the proximity sensor pulses into corresponding analog voltages.

Because the preferred embodiment of the invention calls for the use of a tachometer generator 28, an option strap 62 is used for connecting the generator output analog voltage to junction 54. This strap 62 is factory installed to connect junction 54 either to the tachometer generator 28 or to the proximity sensor 40 since generally, both such devices will not be used with one master control unit. A switch 64 connects junction 54 either to the press speed determining devices, or to a potentiometer R6 which can be manually adjusted by an operator to supply an analog voltage to junction 54 whereupon the master control unit provides a pulse frequency to the spray bar drivers 48 based upon the operator's assessment of the press speed. Generally, switch 64 will be thrown to the manual position upon failure of the press speed determining device.

In keeping with the invention, one of the primary operations carried out is the nonlinear conversion of the indication of the press speed into a pulse frequency for determining the amount of dampening fluid applied to a roller by the spray bar 16. To that end, an analog translator 58 translates the analog voltage appearing at junction 54 into a corresponding digital indication appearing on its output bus 68 consisting of a plurality of wires. Of the plurality of electrical wires in bus 68, only one or two will be active to indicate the magnitude of the analog voltage appearing at junction 54. A dot graph display 70 is responsive to the active wires in bus 68 to produce a visual indication, in graphical form, of the press speed. A frequency selector circuit 72 is also responsive to the active wires in bus 68 to select a frequency generated by a multifrequency pulse generator 74 and enable first frequency designated the "present frequency" and a second frequency designated the "previous frequency". It will be set out more fully below the scheme utilized to select a pulse generator frequency based upon the magnitude of the analog voltage translated by analog translator 58.

The "present" and "previous" frequencies are respectively decoded by the decoders 76 and 78, driven by drivers 80 and 82, and displayed on numeric frequency displays 84 and 86. With this arrangement an operator can quickly ascertain the frequency at which the spray nozzles are presently being pulsed, as well as the previous pulse rate.

The present frequency signals generated by the circuitry described above are further conditioned by circuitry illustrated in functional form on the bottom half of FIG. 2. The general aim of these circuits is to couple the selected frequency to the spray bar driver circuit 48 when the press speed is between a window defined by a predetermined speed on press start-up and a speed on press shut-down.

Figure 6:
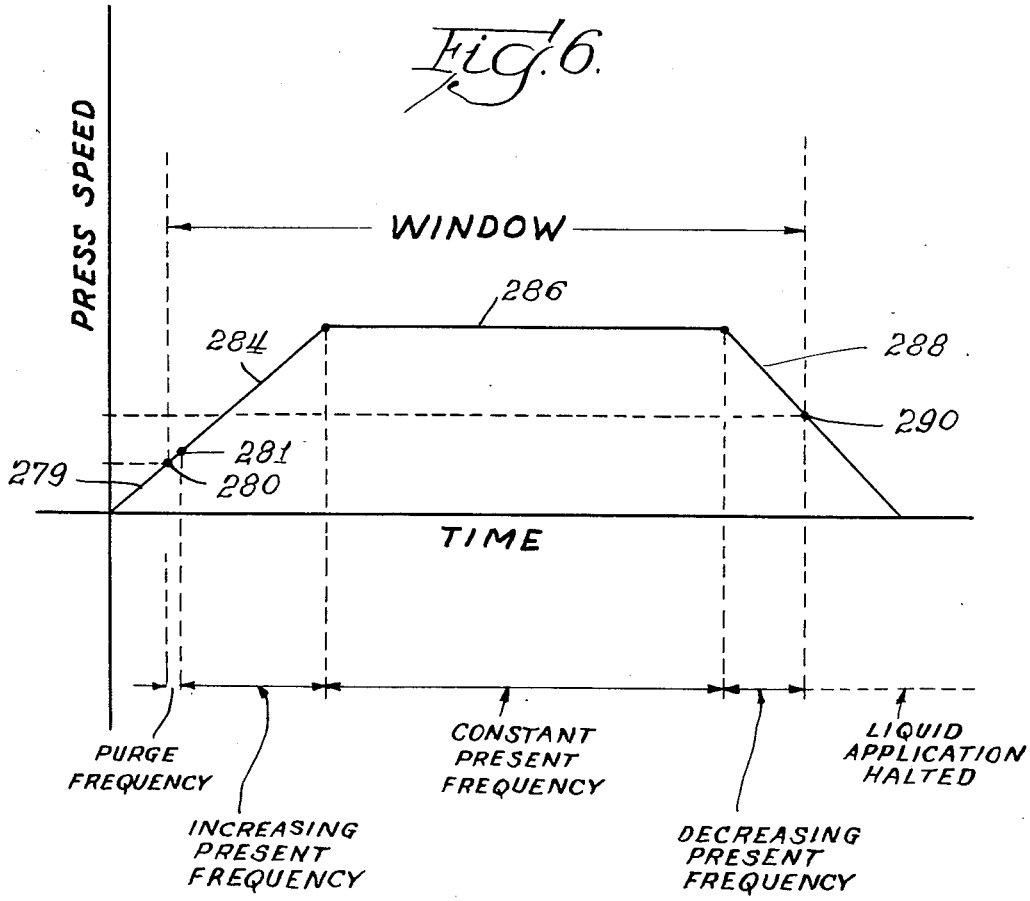
FIG. 6 is a graphical illustration of a press speed cycle showing the window portion where the spray nozzles are pulsed at a frequency corresponding generally to that shown on the graph of FIG. 5.

FIG. 6 generally illustrates the window to which the start/drop-out circuit is responsive. When the press speed is outside these limits, the present frequency is inhibited from driving the spray bar driver circuit 48, and in addition when the press speed is below the lower limit on press start-up an automatic purge circuit is activatable to cause a higher-than-normal frequency to be coupled to the spray bar driver circuit 48.

Particularly, a comparator circuit 88 comprising a pair of operational amplifiers compares the analog voltage against fixed voltage inputs and provides an output with a first and second transition representative of the predetermined start-up and shut-down speeds. When the press speed is low such as on start-up of the press, and when the analog voltage at junction 54 is equal to one fixed reference voltage, the first output transition is generated whereby the present frequency is prevented from being coupled through the automatic purge circuit 92 to the start/drop-out circuit 90. In this event, and if the purge switch 94 has been closed, the automatic purge circuit 92 will be activated to permit the purge frequency 96 to be coupled to the start/drop-out circuit 90 and through electrical isolation means 98 to the spray bar driver circuit 48.

The frequency of the purge signal is higher than it normally would be for a given press speed to thereby increase the amount of spray iquid applied to certain rollers and precondition them for processing at increased speeds which would normally follow on a system being initially started. After a predetermined period of time the purge circuit 92 times out and the present frequency is allowed to be coupled through the automatic purge circuit 92 and the start/drop-out circuit 90. The isolation means 98 will be discussed more thoroughly below, but for a sufficient understanding here it should be noted that the isolation means electrically isolates its input from its output to thereby prevent catastrophic electrical failures and noise from propogating between circuits.

The press speed continues to increase until it reaches the speed desired by the operator while new present frequencies which correspond to the changing press speed, continue to be applied to the spray bar driver circuit 48.

On shutting down the system the press speed decreases and transcends through a point which is sensed by comparator 88 which produces a second output transition which signals the start/drop-out circuit 90 to prevent any frequencies from being coupled to the spray bar driver circuit 48. With this arrangement, spray dampening fluid is conserved as it is recognized that the printing operation has been halted and the application of spray dampening fluid would be unnecessary and thereby wasted. The start/drop-out circuit 90 prevents signals of any frequencies from passing through it until start-up of the press is initiated, and then comparator 88 detects the predefined start-up speed and again produces the first output transition whereupon the entire operational cycle is repeated.

Comparator 100, start/drop-out circuit 102 and isolation means 104 function identically to their counterparts in FIG. 2, except that no purge frequency signal is involved. In other words, the present frequency is applied to other spray bar driver circuit (not shown) on the first transition when the speed transcends through a predetermined speed, and the present frequency is removed from the respective spray bar driver circuit as the press speed on shut-off decreases and passes through a predetermined speed.

Each isolation means 98 and 104 is capable of driving a plurality of spray bar driver circuits, one such circuit shown as reference character 48 in FIG. 2. In the preferred embodiment each spray bar 16 (FIG. 1) includes four solenoid-controlled spray nozzles 18*a–d*, each driven by a dedicated circuit shown within the spray bar driver circuit 48 of FIG. 2. The electrical signals generated by the master control unit 44 are at frequencies determined by the speed of the press. In accordance with the invention a further control over the amount of spray fluid applied to the various rollers may be achieved by varying the width of the pulse before it is applied to its respective spray nozzle. The spray bar driver circuit 48 illustrated in FIG. 2 includes a pulse width adjustment means 50 for adjusting the duty cycle of the electrical pulse applied to the solenoid spray nozzle 18*a* to thereby further adjust and fine tune the volume of spray liquid applied to the roller. Solenoid driver 53 provides the necessary current for driving the winding of the spray nozzle solenoid. A switch 52 is also provided for disabling the driver, thus preventing the application of any frequency to the solenoid spray nozzle 18*a*.

Within each spray bar driver circuit 48 is a purge frequency generator 106, along with a manual purge circuit 108, which can be manually activated with momentary push button switch 110. In this manner an operator who observes that the amount of spray liquid to a particular roller should be increased, he simply operates button 110 to increase the effective frequency of operation of the solenoid spray nozzles for a timed interval and thereby increase the amount of fluid applied.

The spray dampening system of the present invention is further augmented by the provision of an auxiliary frequency generator 112 with a variable frequency which can be applied to the spray driver circuit 48 through switch 114. The auxiliary frequency generator 112 acts as a backup in the event the master control unit 44 fails. In the event of such a failure the isolation means 98 prevents the failure of the master control unit 44 from affecting the spray bar driver circuit 48. The provision of the auxiliary frequency generator 112 thus allows the continued operation of the system by supplying a signal to the driver circuits with a manually adjustable frequency similar to that which was previously supplied by the master unit 44. An operator can adjust the frequency of the auxiliary generator 112, as previously observed on a numeric frequency display 114, to correspond the press speed. A correlation between the press speed and the frequency of the generator 112 may also be made with the use of a chart, graph or the like which will be discussed below.

Master Control Unit

Figure 3A:
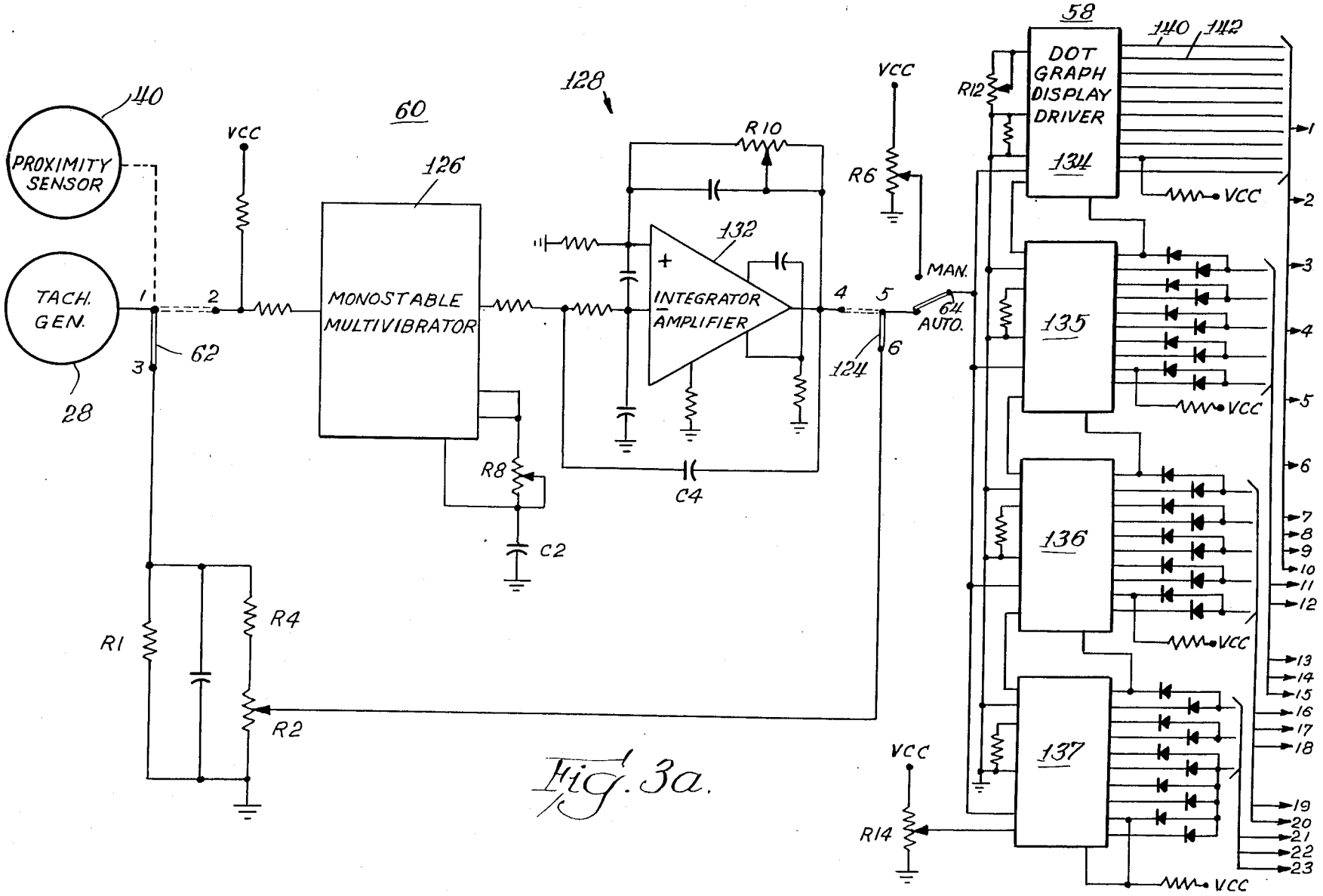
FIGS. 3*a–d* when joined together are detailed electrical drawings of the circuits which perform the functions generally shown in the functional block diagram of FIG. 2.

For a detailed understanding of the preferred embodiment of the invention, reference should now be had to FIGS. 3*a–d*. As noted earlier, the master control unit 44 is provided with inputs for a tachometer generator 28 supplying an analog voltage with an instantaneous voltage level representative of the press speed, or a proximity sensor 40 supplying pulses at a frequency representative of the press speed. In FIG. 3*a* the master control unit has a electrical conductor 62 strapped between lugs 1 and 3 to select the tachometer generator 28 input. Because the output voltage range (0–50 volts) of the generator 28 is greater than that required by the circuit, resistors R1, R4 and potentiometer R2 form a divider network whereby the voltage appearing on conductor 122 is a scaled-down representation of the tachometer generator output voltage. Therefore, with switch 64 in the position shown, and with factory installed jumper 124 installed as shown between lugs 5 and 6, a scaled-down analog voltage, linearly tracking the press speed, appears at junction 54.

Should the proximity sensor 40 input option be desired, jumpers 62 and 124 would be factory installed at the positions shown by the respective dotted lines, and the frequency-to-voltage converter 60 would be employed. The converter 60 is comprised of a monostable 126 and an integrator 128. As noted before, the output of the proximity sensor 40 generates a series of pulses with a frequency representative of the press speed. However, the width of each pulse also varies with press speed which adds another variable unnecessary to the determination of press speed. Therefore, the monostable 126 is adjusted by potentiometer R8 so that the output pulse appearing on conductor 130 has a width larger than the width of any pulse transmitted by proximity sensor 40. Monostable 126 is of conventional design and is connected to be triggered on the leading edge transition of each proximity sensor pulse to produce an output pulse of width depending upon the values of resistor R8 and capacitor C2. Because the values of R8 and C2 are chosen to establish a monostable output pulse of width greater than any of its input pulses, the signals appearing on conductor 130 contain only one variable, namely the time varying frequency information corresponding to press speed.

The frequency-to-voltage converter 128 is comprised of an operational amplifier 132, capacitor C4 and potentiometer R10 connected from the amplifier output to its inverting input to integrate or filter the input electrical signals into a corresponding output to a particular DC voltage varying in magnitude according to press speed. Potentiometer R10 is utilized to calibrate the amplifier output to a particular DC voltage at a predetermined input frequency. It can thus be seen that the voltage appearing at junction 54 is DC in nature, but varies in magnitude according to the speed of the press irrespective of whether a proximity sensor 40 or a tachometer generator 28 is selected as the speed sensing device. In the event of the failure of a press speed sensing device, or of the frequency-to-voltage converter 60, potentiometer R6 is provided to supply an adjustable DC voltage to junction 54. Upon ascertaining a failure of one of the aforementioned elements an operator simply throws switch 64 from the automatic position to the manual position, and adjusts the potentiometer R6 to achieve a voltage at junction 54 which corresponds to the present press speed.

The analog translator 58 produces an output digital indication corresponding to the magnitude of its analog input voltage. The translator 58 is comprised of a plurality of dot graph display drivers. The particular devices used are LM3914N integrated circuits manufactured by National Semiconductor, Inc. The dot graph display drivers 134–137 are connected in series in a conventional manner so that as the analog voltage at junction 54 increases, the driver outputs go to a logic low in an ascending order, one at a time. The display trim potentiometers R12 and R14 are adjusted so that the logic level changes at adjacent outputs of different drivers, the press speed has changed a desired multiple of two thousand papers per hour. In the preferred embodiment a logic low on output 140 of dot graph display driver 134 corresponds to a press speed of 2,000 papers per hour. A logic low appearing on output 142 corresponds to a press speed of 4,000 papers per hour, and so on with the remaining output conductors of dot graph display drivers 135–137.

Figure 3B:
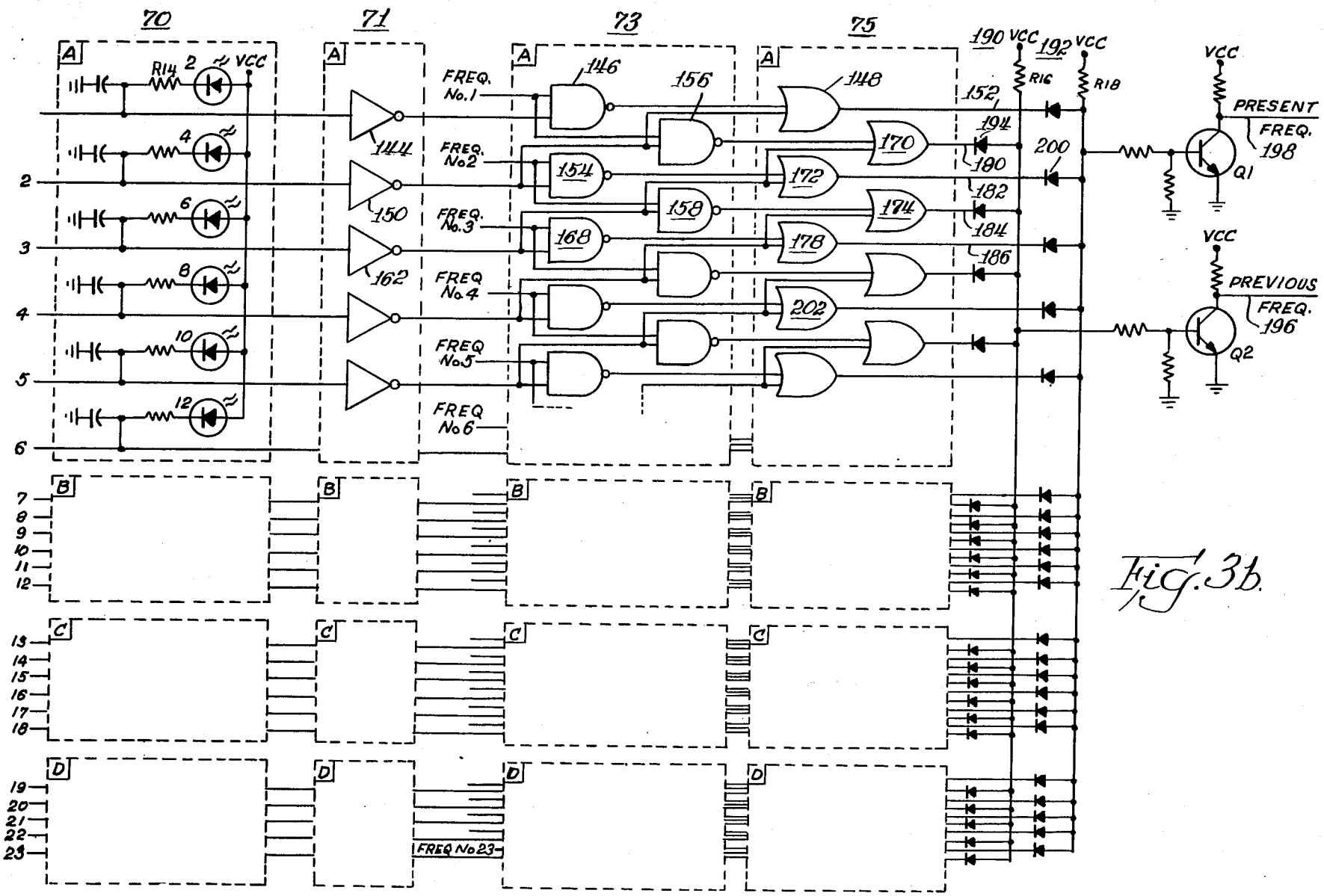

When FIGS. 3*a* and 3*b* are placed end to end it will be seen that the respective dot graph display driver outputs are connected to a plurality of LED indicators 70 marked numerically according to the papers per hour processed by the operation. It should be realized that the markings on the indicator LEDs are in thousands of papers per hour with increments of 2,000 up to 22,000 papers per hour where the rate is then recognized in increments of 4,000 papers per hour. For this reason output conductor pairs on dot graph display drivers 135–137 are diode ORed together to give a single output indication when either one of the output pairs is at a logic low. In the illustrated embodiment visual indications of the paper flow rate range from 2,000 papers per hour up to and including 70,000 papers per hour.

The anode of each LED 69 is connected to the supply voltage and thus a logic low appearing on any display driver output will forward bias the respective LED and cause it to emit a visual indication of the paper flow rate. Resistor R14 limits the current of LED 71 to a safe value, and capacitor C5 prevents LED flicker as the press speed transcends from one detected speed to another.

In addition to driving the dot graph display 70, each output of the dot graph display drivers 134–137 is inverted at stage 71 and is applied to a frequency selection circuit 72 which includes a frequency enable circuit 73 and a priority override circuit 75.

In the overall operation of the frequency select circuit 72 a plurality of predetermined frequencies are applied to a corresponding plurality of inputs to the enable stage 73 and, based upon the present speed of the press, only a single frequency will be enabled to be passed to the output to drive the spray bar driver circuit. It will be discussed below a manner in which the individual frequencies are generated.

To make the frequency selection process clear by way of example, it may first be observed in FIG. 3*b* that when the press operation attains a speed corresponding to 2,000 papers per hour dot graph display output conductor 140 goes to a logic low. This logic low is inverted to a high by inverter 144 and applied to NAND gate 146. On the other input of NAND gate 146 appears Frequency No. 1. The output of NAND gate 146 consists of inverted Frequency No. 1 which is applied to one input of OR gate 148. On the other input of OR gate 148 is the inverted logic level of display driver output conductor 142 which, in the present example, is at a logic high because a speed of 4,000 per second has not yet been attained. Thus, the output of inverter 150, being a logic low, enables the frequency signals to be passed through OR gate 148 to its output 152. Furthermore, since the output of inverter 150 is at a logic low Frequency No. 2 is prevented from passing through NAND gates 154 and 156 and appearing at the input of the priority override stage 75. It should be noted that the remaining inverters in the inverter stage 71 have outputs which are also low thereby preventing their respective frequencies from being coupled to the input of the priority override stage 75. Thus, at this press speed the only frequency to appear at the output of the priority override stage 75 is Frequency No. 1 corresponding 2,000 papers per hour.

Assuming the press speed is increasing, a point will be reached where the analog voltage at junction 54 increases to the extent that the analog translator 58 will detect it and cause output conductor 142 to go to a logic low level. It should be realized that with the particular devices used, dot graph display output conductors 140 and 142 may simultaneously be at a logic low level during the transition from a press speed of 2,000 papers per second to a press speed of 4,000 papers per second. Because of the ambiguity apparent during this transition the priority override stage 75 prevents both Frequency No. 1 and Frequency No. 2 from being coupled to its output. This is apparent as the solenoid-operated nozzles should only be pulsed at a single desired frequency until a new different frequency is chosen. More particularly, the priority override stage 75 couples the highest of the two frequencies to its output, namely Frequency No. 2 in this example.

In achieving this end, and assuming conductors 140 and 142 are both at a logic low, while conductor 160 is at a logic high, the respective outputs of inverters 144, 150, and 162 will be at a respective logic high, high and low. It should be noted that the outputs of the remaining inverters in stage 71 are all at a logic low.

Before proceeding further with the description of the priority override stage, it should be noted that the outputs of alternate OR gates in stage 75 are connected to a first diode ladder network 190, and a second diode ladder network 192. Each network 190 and 192 has the anodes of its diodes connected in common to respective pull-up resistors R16 and R18. The common anode point of each such diode network 190 and 192 is also coupled to a respective "present frequency" driver transistor Q1, and a "previous frequency" driver transistor Q2. It is the aim of the present invention to thereby provide two frequencies, namely a "present frequency" for use in driving the solenoid-operated spray nozzles, and a "previous frequency" for visual display purposes.

Turning again to the example where the press speed has reached 4,000 papers per hour (PPH), it will be remembered that the output of inverter 150 is at a logic high which high appears at the input of OR gate 148 thereby preventing Frequency No. 1 from being coupled to diode ladder network 192. This same logic high on conductor 164 does, however, enable Frequency No. 1 at the input of NAND gate 156 whereupon OR gate 170 has on one of its inputs this lower frequency. The output conductor 166 of inverter 162, which is also coupled to the other input of OR gate 170, enables Frequency No. 1 to be coupled to diode ladder network 190 by diode 194. It will be seen that the remaining diodes forming a part of network 190 have no frequencies coupled to their cathodes and thus the only frequency on the common anode side is that of Frequency No. 1. Driver transistor Q2 now couples Frequency No. 1, which was the present frequency at 2,000 papers per hour, to the "previous frequency" bus 196.

At the rate of 4,000 papers per hour the logic high appearing on inverter output conductor 164 enables Frequency No. 2 appearing at the input of NAND gate 154. As a consequence, Frequency No. 2 is coupled to one input of OR gate 172. Again, because inverter output conductor 166 is at a logic low and the other input of OR gate 172 is at a low, Frequency No. 2 is coupled to diode ladder network 192 by way of diode 200. As no other frequencies appear on the remaining diode cathodes in network 192, Frequency No. 2 is coupled to the "present frequency" bus 198 by transistor Q1.

With regard yet to Frequency No. 2 which is also coupled to one input of NAND gate 158, the logic low on inverter output conductor 166 prevents such frequency from being coupled through NAND gate 158 by producing a logic high at one input of OR gate 174 thereby inhibiting Frequency No. 2 from being coupled to the diode network 190. With this arrangement, it should be understood that each frequency is capable of being coupled to either the diode ladder network 190, or network 192. In the present example where the press has attained a speed (4,000 PPH) such that the analog translator 58 becomes operative to enable Frequency No. 1 and No. 2, such frequencies are appropriately selected, and specifically selected such that Frequency No. 1 becomes the previous frequency, and Frequency No. 2 becomes the present frequency. However, from the foregoing example and description it can ascertained by those skilled in the art that when the press speed increases further such that Frequency No. 2 and 3 are enabled by the translator 58, Frequency No. 2 will be coupled by OR gate 174 to diode network 190 and thus appear as a previous frequency on bus 196. Of course, Frequency No. 3 will then be coupled to diode network 192 by OR gate 202, and thus to the present frequency bus 198 by transistor Q1.

In brief summary, by the arrangement of the connections between the NAND gate stage 73 and the OR gate stage 75 each frequency, upon its being selected, is first coupled to the present frequency bus 198 by diode network 192, and then at the next speed change to the previous frequency bus 196 by diode network 190. Thus, the higher frequency of the two contending frequencies is coupled to the present frequency bus 198, and the lower frequency of the two contending frequencies is coupled to the previous frequency bus 196.

The foregoing describes those situations where the press speed is at a point where the analog translator 58 is making a transition between selecting what was the old present frequency and a new higher frequency. There are, of course, many other occasions where there is no contention between frequencies and the analog translator 58 produces a single output indication whereupon only one frequency is selected. This situation exists where the press speed is intermediate the 2,000; 4,000; 6,000; etc. transistion points. In this event, only one LED will be lit, and the corresponding frequency will be output on the present frequency bus 198.

In accordance with the drawing convention used herein, and for the sake of completeness, the dashed blocks in FIG. 3*b* labeled B, C and D include circuitry (not shown) identical to that shown in the dashed block A immediately above the phantom blocks. This convention is also used throughout the various drawings described below.

Turning now to FIG. 4 there is shown one of a plurality of pulse generators which produces two frequencies appearing at two inputs to the NAND gate stage 73 of FIG. 3*b*. In the preferred embodiment, pulse generator 206 is a dual monostable multivibrator conventionally connected to operate in an astable mode. Specifically, pulse generator 206 is a type LM556 integrated circuit manufactured by National Semiconductor, Inc. Such an integrated circuit is capable of producing and independently controlling, two pulse frequencies. The value of resistors R20, R22 and capacitor C8 are conventionally chosen to produce a desired Frequency No. 1 on output 208. Similarly, the value of resistors R24, R26 and capacitor C10 are chosen to produce a desired Frequency No. 2 on output 210.

A plurality of pulse generators similar to that shown in FIG. 4, with components chosen to produce other different desired frequencies, comprise the multifrequency pulse generator 74 shown in FIG. 2. Of course, those skilled in the art may prefer to employ other means for generating a plurality of disparate frequencies.

Figure 5:
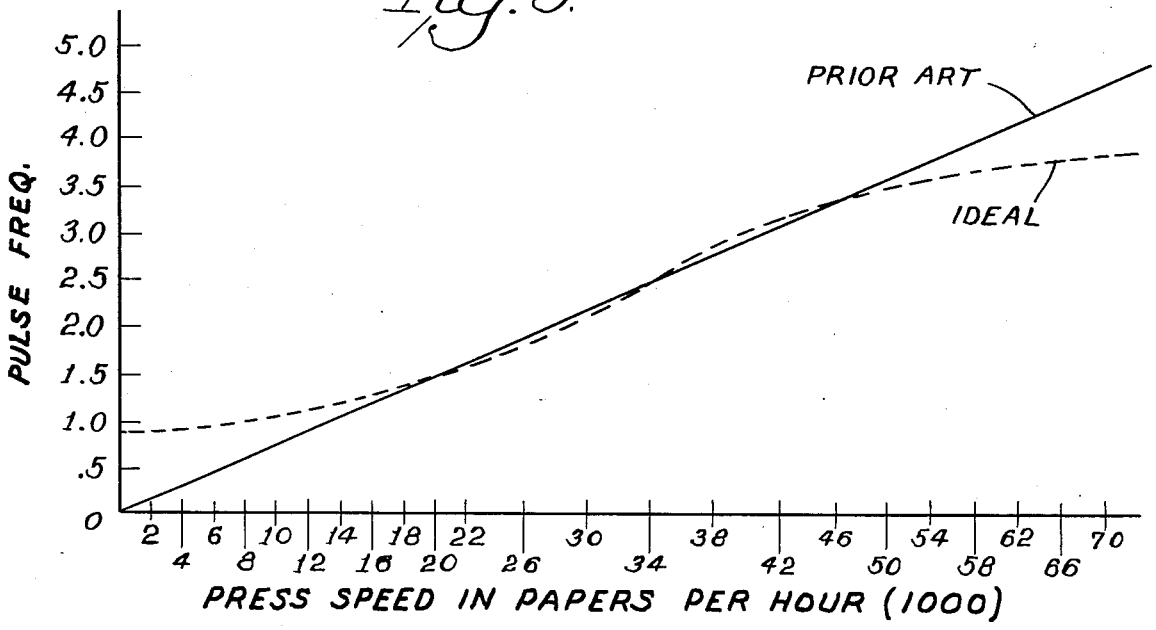
FIG. 5 is a graphical illustration of the nonlinear transfer function of the nozzle pulse frequency versus press speed characteristics of the spray dampening control system.

In accordance with an important feature of the invention, the nonlinear relationship between the press speed and the frequency at which the spray nozzles are pulsed, is achieved by providing frequencies with nonlinear ascending increments to the NAND gate stage 73. This nonlinear relationship is shown in FIG. 5, and is to be compared with the traditional approach shown by the linear line labeled "prior art". The derivation of the nonlinear conversion is readily understood by observing that the outputs of the analog translator 58 are linearly activated to linearly enable the various gates in the NAND gate stage 73, but the actual frequencies enabled at stage 73 nonlinearly increase in frequency.

Stated another way, the graph of FIG. 5 shows on the abscissa axis the press speed in thousands of papers per hour in direct correspondence with the LED markings. It is understood that the press speed is directly related to the paper processing rate of the exemplary printing operation. The ordinate axis of the graph illustrates the frequencies at which the spray nozzles are pulsed, commonly designated herein as the "present frequency". With prior art systems the pulse rate varied linearly from near zero pulses at 2,000 papers per hour to five pulses per second at 70,000 PPH. As noted before, it has been found by experimentation and experience that this relation does not provide for optimum efficiency or printing quality. However, with the relationship shown by the nonlinear line "ideal" the printing quality and efficiency is optimized.

By the use of the nonlinear relationship shown in FIG. 5 each pulse generator shown in FIG. 4 can be adjusted to provide a frequency on the nonlinear "ideal" line, and the output of each such generator is connected to the NAND stage 73 input which becomes selected at the press speed (and thus the paper rate) in accordance with the respective point on the abscissa axis of the graph. Thus, at low press speeds in the range if 2,000–10,000 PPH the frequency increments will be small. This is also true of high press speeds in the range of 50,000–70,000 PPH. However, in the intermediate press speed range the pulse frequencies increase by constant increments and thus are generally linearly related to the press speed. Depending on various idiosyncrasies of particular printing systems, or the compositions of the wetting solutions or printing inks, other nonlinear relationships, different from that shown in FIG. 5, may be found to optimize that particular system. In the preferred embodiment of the invention the actual frequencies generated by the multifrequency generator 74 are higher than shown in FIG. 5, but because of frequency dividers in the frequency signal path, the resultant frequency appears as shown in the figure.

Figure 3C:
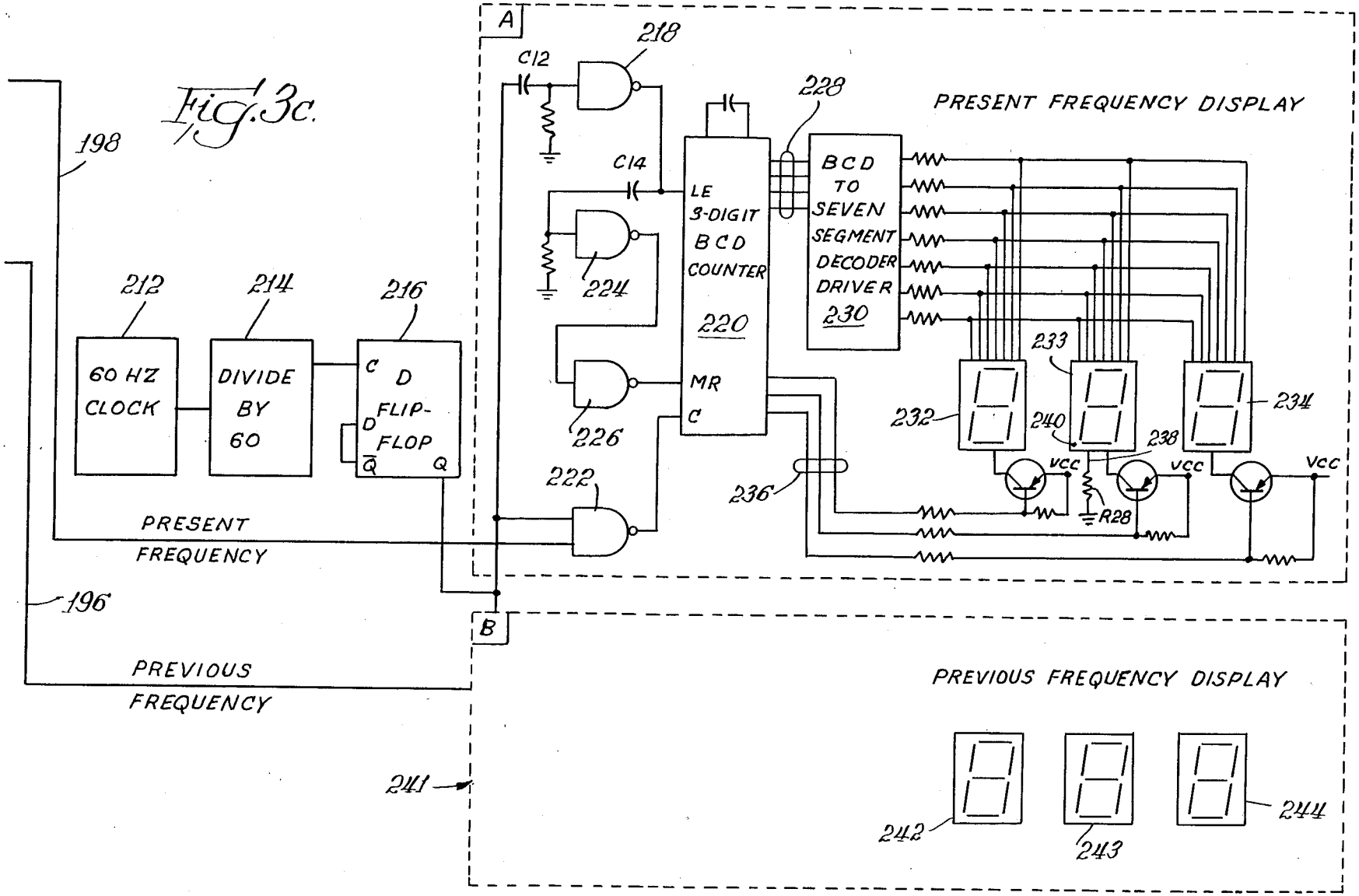

The details of the numeric frequency display for giving a visual indication of the "present" and "previous" frequencies are shown in FIG. 3*c*. For the sake of brevity the details of one display circuit will be shown, it being understood that the other display is identically constructed and functions in an identical manner. The time base for the frequency display of FIG. 3*c* is a sixty hertz clock 212 followed by a divide-by-sixty circuit 214 which, in turn, is followed by a D-type flip-flop 216. The output of the divide-by-sixty circuit 214 is a one hertz signal which, after being processed by the D flip-flop results in a one-half hertz fifty percent duty cycle signal used for clocking the frequency display circuits.

Capacitor C12 is responsive to the transitions of the one-half hertz D flip-flop output by passing a differentiated signal to NAND gate 218. Gate 218 squares the differentiated signal into a pulse fed to the latch enable input of the three-digit BCD counter 220. BCD counter 220 also includes internal counters which count the number of pulses appearing at its C input. It should be realized that the number of pulses per second is representative of the frequency of the pulse train. The present frequency generated by the pulse dampening control system appears at one input of NAND gate 222, and on its other input there appears the one-half hertz D flip-flop output. On the output of NAND gate 222, and thus at the C input of the BCD counter 220, is a one second sample of the present frequency followed by a one second logic high. BCD counter 220 counts the number of pulses comprising the sample of the present frequency, and the result thereof is stored in internal latches on the occurrence of the latch enable pulse at the LE input. Capacitor C14 serves to delay the differentiated output of NAND gate 218, and thus provides a delayed pulse on the master reset MR input of counter 220 preparing it for a new cycle.

The binary coded decimal BCD outputs of the BCD counter 220 are coupled to a BCD-to-seven segment decoder driver integrated circuit 230 which conventionally decodes the BCD logic state on conductors 228 into a state suitable for operating the seven segment display devices as depicted by elements 232–234. The display devices 232–234 are driven in a multiplexed manner and thus the decoder driver 230 outputs are connected in parallel to each display device. A second set of BCD counter outputs 236 provides timing pulses for three digit multiplexing to drive each display device in a timed relationship according to the decoder driver 230 outputs. Since multiple display multiplexing is well known in the art, the description herein will not be encumbered with further details. According to the preferred form of the invention, the resulting frequencies generated by the multifrequency pulse generator 74 (after division) fall in a range of about one-half to no more than five hertz. Therefore, conductor 238 of display device 233 is permanently grounded through resistor R28 to illuminate a permanent decimal point between display device 232 and devices 233. This decimal 240 provides that the display as a whole will not indicate a reading greater than 9.99.

The previous frequency on conductor 196 along with the half hertz D flip-flop output are fed to circuit 241 to illuminate the previous frequency on display devices 242–244 in a manner similar to that described with respect to the present frequency display.

Figure 3D:
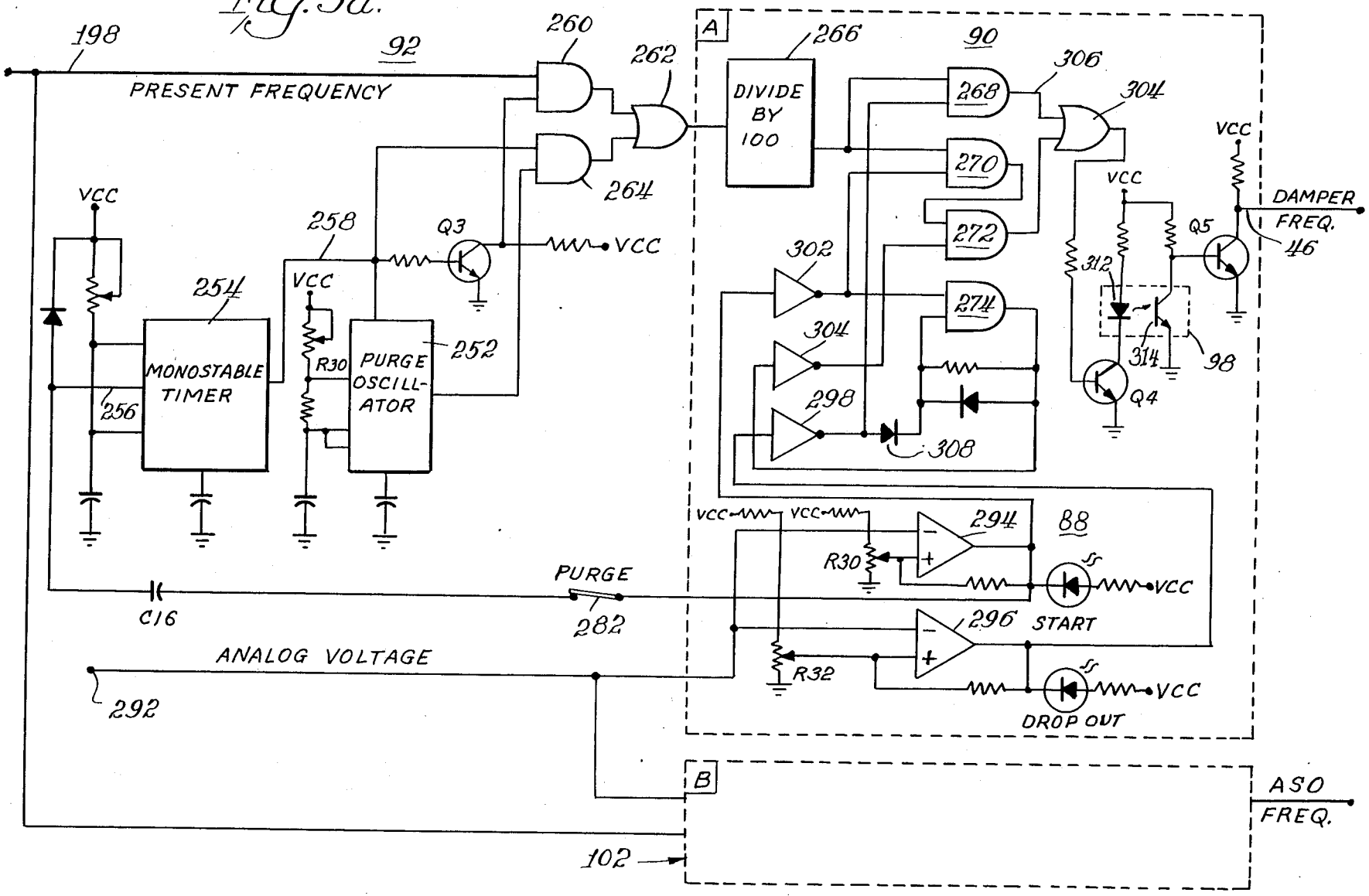

Moving now to FIG. 3*d* a purge circuit is provided for automatically overriding the present frequency at low press speeds. FIG. 3*d* also provides a window below and above which the present frequency is prevented from being transferred to the spray dampener frequency output 46. The primary frequency of the purge circuit is generated by purge frequency oscillator 252 which is a monostable connected to operate in an astable manner. The output frequency of oscillator 252 is adjusted by potentiometer R30 for an output in the range of 200–450 hertz. The duration of the purge cycle is determined by monostable timer 254 which is triggered by a low-going pulse on conductor 256 whereupon a positive-going pulse is produced on output conductor 258 to cause three events to occur. First, the monostable timer output 258 is coupled to an input of oscillator 252 to activate it, and secondly the monostable timer 254 output pulse causes transistor Q3 to conduct and apply a logic low to one input of AND gate 260. The logic low on AND gate 260 effectively prevents the present frequency on its other input from being coupled to OR gate 262. However, the monostable 254 output logic high applied to one input of AND gate 264 permits the purge oscillator frequency appearing on its other input to be applied to OR gate 262. Essentially, when the purge circuit is activated, which is anywhere from one to seven seconds, the present frequency is disabled. Irrespective of whether the present frequency or the purge frequency is invoked, such frequency is divided by a factor of 100 by divider 266 before the frequency is applied to an input of each AND gate 268 and 270. Depending on the speed of the press, as sensed by the start/drop-out circuit described below, the frequency appearing at inputs of AND gates 260 or 272 may, or may not, be coupled to the dampener frequency output 46.

With brief reference now to FIG. 6 there is shown a graphical depiction of the window created by the start/drop-out circuit 90. The solid curved line in FIG. 6 represents a typical printing operation cycle having a start-up period of time when the press speed is increasing to establish a desired paper processing rate, and a period of time when such rate is reached and the speed remains essentially constant. After the desired number of papers have been processed, or because of mechanical difficulties, the press is shut down and the speed begins to gradually decrease until it is stopped.

It is the purpose of the start/drop-out circuit 90 to prevent the spray nozzles from being pulsed when the press speed is below that point on the curve represented by reference character 280. In this situation, and if the auto purge switch 282 (FIG. 3*d*) is closed, the purge frequency, as divided down by divider 266, will be applied to the dampener frequency output 46. At such time when the press speed is increasing, as depicted by reference character 284, the present frequency which is selectively being increased also, is applied to the dampener frequency output 46. On curve portion 286, representative of the time when the printing operation is running in a steady state manner, the present frequency remains relatively constant. However, should an operator decide to increase or decrease the speed to optimize the operation, the present frequency will increase or decrease according to the FIG. 5 curve to achieve optimum results.

Once the speed of the press commences decreasing, for whatever reason, curve portion 288 corresponds to a decreasing present frequency which decreases in accordance with the nonlinear curve described above in connection with FIG. 5. As point 290 is reached on the curve of FIG. 6, the start/drop-out circuit 90 inhibits the present frequency from appearing at the dampener frequency output 46, and all further application of spray liquid to the rollers is halted. Points 280 and 290 on the speed curve represent respective limits between which the spray nozzles are pulsed with a present frequency according to the described scheme. It is to be noted that if the Auto Purge Switch 282 is open, the present frequency, rather than the purge frequency, will be operative at point 280 on the FIG. 6 curve. In addition, points 280 and 290 on the press speed curve can be adjusted along the curve according to the particular needs of the user by adjusting potentiometers R30 or R32.

Returning now to FIG. 3*d* the same analog voltage appearing at junction 54 in FIG. 3*a* is applied to junction 292 and thus to the inverting inputs of operational amplifiers 294 and 296. Applied to the noninverting inputs of such amplifiers is a reference voltage which matches the analog voltage which would be present at junction 292 when the press speed equals points 280 and 290 on the curve of FIG. 6. Start-up amplifier 294 output is normally high with a zero press speed, and potentiometer R30 is adjusted such that when the analog voltage at junction 292 corresponds to the start-up speed represented by point 280 on the FIG. 6 curve, the output of amplifier 294 goes low. Potentiometer R32 is similarly adjusted such that the output of operational amplifier 296 goes low at a press speed corresponding to point 290 on the curve shown in FIG. 6.

For exemplary purposes, and assuming the press speed increases from zero upwardly, the output of amplifiers 294 and 296 will initially be at logic high levels. The logic high of drop-out amplifier 296 output is inverted by inverter 298 and appears as a logic low at the input of AND gate 268 thereby preventing the purge frequency or the present frequency from being coupled to OR gate 304 by conductor 306. The logic high output of start-up amplifier 294 is also inverted by inverter 302 and prevents either the purge frequency or the present frequency from being coupled through series AND gates 270 and 272 to the input of OR gate 304. Thus, during the period depicted by character 279 in FIG. 6 all frequencies are prevented from being applied to the solenoid-operated spray dampening nozzles.

At point 280 on the curve of FIG. 6, the analog voltage at junction 292 becomes greater than the reference voltage on the noninverting input of start-up amplifier 294, whereby its output goes to a logic low and causes two events. First, if the purge switch 282 is closed the low-going signal will be coupled through capacitor C16 to trigger monostable timer 254 and initiate a purge cycle. As discussed previously in connection with the purge circuit 92, the initiation of this cycle automatically overrides the present frequency. Secondly, the logic low output of start-up amplifer 294 is inverted by inverter 302 to a logic high and applied to one input of AND gate 270. This allows the purge frequency which is present on the other input of gate 270 to be applied to one input of gate 272. The other input of AND gate 272 is normally at a logic high because the output of AND gate 274 is normally a logic low which is inverted by inverter 300 and applied to gate 272. Because AND gate 272 has a logic high on one input, and the purge frequency is on the other, the output thereof is the purge frequency applied to OR gate 304 which, along with a logic low on its other input, couples the purge frequency to driver transistor Q4.

After a period of time monostable timer 254 times out whereby transistor Q3 enables AND gate 260 to pass the present frequency to OR gate 262 and thus through the start/drop-out circuit 90 to transistor Q4. Point 281 on the press speed curve of FIG. 6 indicates that point in time, as well as the press speed, where the purge frequency ends and the present frequency is allowed to control the pulsing of the spray dampening nozzles.

As the press speed continues to increase along the press speed curve portion 284 the output of drop-out amplifier 296 goes low, is inverted by inverter 298, and the resultant logic high is applied to an input of AND gate 268 which effectively switches the transmission of the present frequency from the output of AND gate 272 to the output of AND gate 268. With this arrangement the transmission of the present frequency to transistor Q4 is not interrupted, but merely switches from one transmission path to another. The logic high on the output of inverter 298 switches the latched output of AND gate 274 to a high which, in turn, is inverted by inverter 304 and disables the present frequency at AND gate 272.

In the typical operational press cycle of FIG. 6 it should be observed that at each press speed, such as that noted by points 280 and 290, the sensing of such speed occurs twice for each cycle. However, the start/drop-out circuit 90 is responsive to the particular speed 280 to enable frequencies only during the rising slope of the press speed curve, which such circuit is responsive to the speed 290 to disable frequencies during only the decreasing slope of the curve. Between points 280 and 290 on the press speed curve is the window during which the present frequency, as selected according to the previously described FIG. 5 scheme, is applied to the solenoid operated nozzles for precise control of the amount of liquid sprayed on the rollers.

The next significant event on the press speed curve is reached at point 290 where the drop-out amplifier 296 senses that the analog voltage at junction 292 drops below the preadjusted voltage on the wiper arm of potentiometer R32, whereupon the output of the amplifier returns to a logic high level. This logic high is inverted to a logic low by inverter 298 and prevents the present frequency from being coupled through gate 268. Because diode 308 is polled with its anode connected to the inverter 298 output, the latched AND gate 274 is unaffected by the inverter output low. Thus, the output of gate 274 remains high and the inverted logic low applied to one input of gate 272 also prevents the present frequency from being from being coupled to OR gate 304. The present frequency is thus inhibited from being coupled to the dampener frequency output 46 during the press speeds represented by point 290 on the FIG. 6 curve and on the remaining downwardly sloping portion of the curve. As the press speed continues to decrease the output of start-up amplifier 294 returns to a high level and, through inverter 302, the latching AND gate 274 is rearmed so that its output returns to a logic low level preparing it for a new cycle.

An optically coupled isolator 98 electrically isolates the start/drop-out circuit 90 from the spray bar driver circuits 48. Functionally, the conduction of transistor Q4 forward biases diode 312 of the optical isolator 98 causing it to emit energy in the form of light. Transistor 314 is optically coupled to the diode 312 and thereby conducts when its base is subjected to light energy. As between the diode 312 and transistor 314 there is no conduction of electrical current, but rather there is a passage of light energy which provides a very high degree of electrical isolation. Thus, catastrophic electrical failures, such as short circuits or overvoltages occurring on the input or output side of the optical isolator 98 cannot propogate to other side and damage circuits. This is highly desirable as a failure in a particular circuit can be dealt with by replacing the circuit module and placing the system quickly back into operation. Optical isolator transistor 314 is coupled to a driver transistor Q5 which provides sufficient pulse current to the various spray bar driver circuits as shown in FIG. 1.

The circuit functionally shown as block 102 in FIG. 3*d* is identical in structure and function to the schematically represented circuit shown directly above it, with the exception that circuit 102 does not include a purge switch, nor is a purge frequency fed to it. In all other respects, the circuits are the same and thus circuit 102 will not be further discussed. The purpose of circuit 102 is, however, for driving solenoid control spray nozzles for applying a dampening fluid to set-off rollers which do not require an initial overapplication of liquid by high frequency purge pulsing. An application of dampening fluid applied to the set-off rollers in accordance with the press speed as before discussed, is sufficient to prevent the ink of freshly printed paper from transferring back to the roller.

Spray Bar Drivers

While the frequencies generated by the master control unit 44 described above may be used directly to drive any of a variety of solenoid-controlled spray nozzles, the invention provides additional control at the spray bar driver level for further controlling and individually adjusting the amount of spray fluid dispensed by each nozzle. Accordingly, FIG. 7 illustrates the manner in which each electrical pulse is further conditioned as to its width, independently of its frequency as determined by the master control unit 44.

Figure 7A:
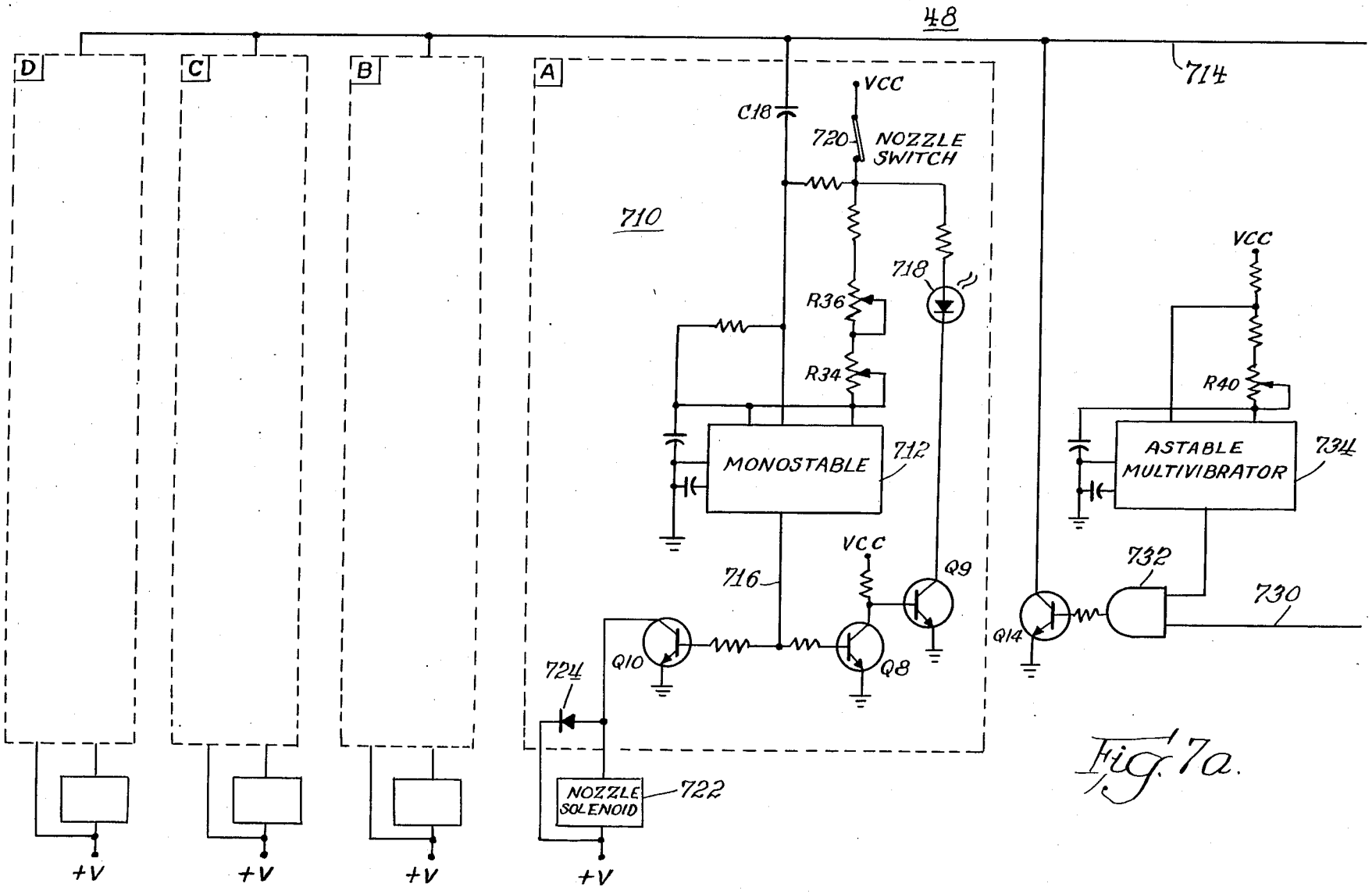
FIGS. 7*a* and 7*b*, when joined together illustrate an electrical circuit drawing of a spray bar driver unit employed to further control the volume of liquid sprayed from each nozzle of the spray bar.
Figure 7B:
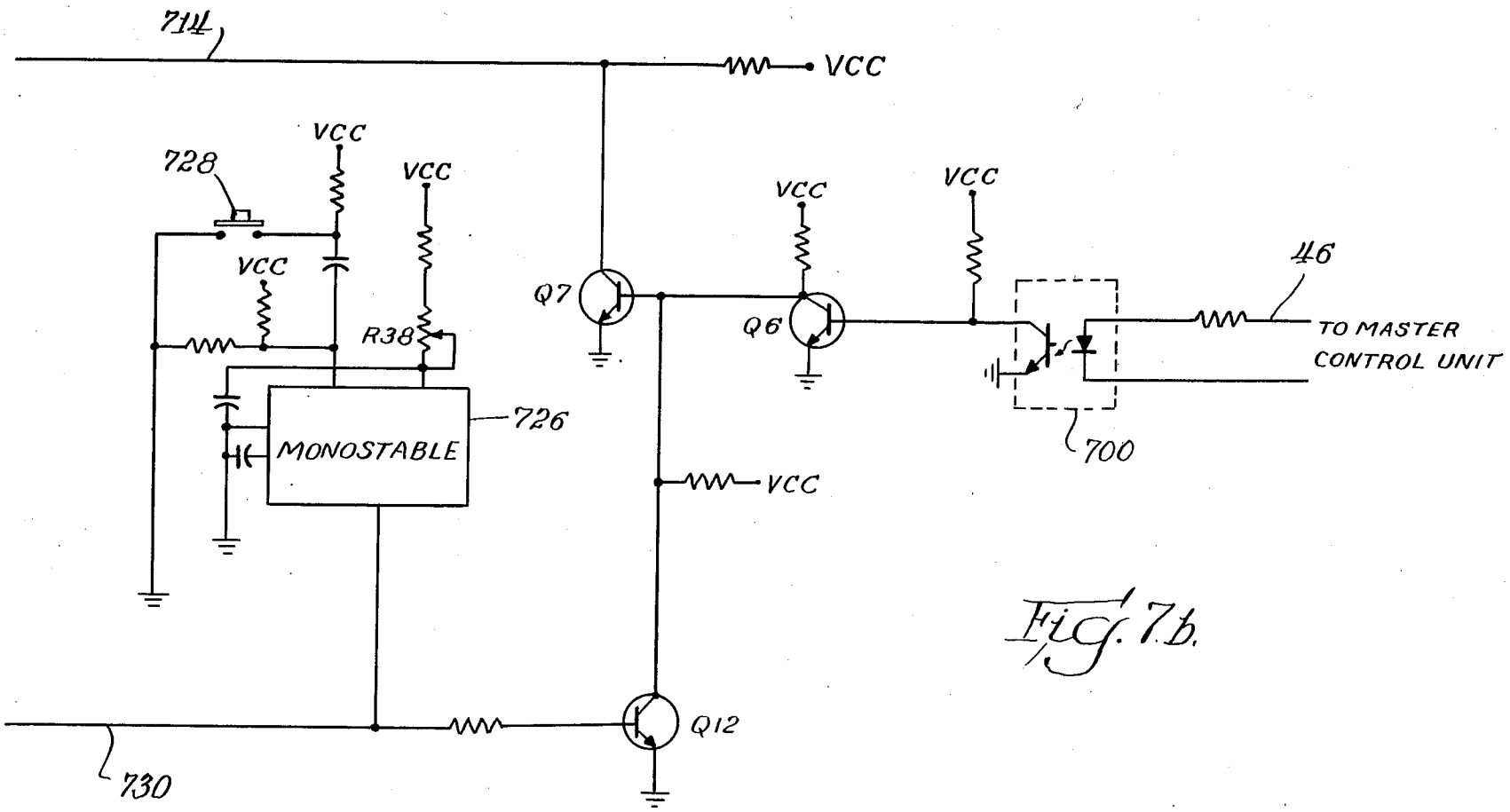

Referring specifically to FIGS. 7*a* and 7*b*, each spray bar driver 48 of the plurality of drivers driven by the master control 44 via the distribution bus 46 (FIG. 1) is isolated from such control by an optical isolator 700. Thus, a malfunction in one spray bar driver will not affect another spray bar driver. Moreover, the propogation between circuits of electrical noise generated by the operation and release of the nozzle solenoids is reduced by the use of optical coupling. Transistor 702 couples the frequency from the optical isolator 700 to a driver transistor 704 which supplies sufficient current to drive a plurality of nozzle-driving circuits in one spray bar circuit 48. One such nozzle-driving circuit is shown generally at 710, it being understood that the remaining nozzle-driving circuits B, C and D associated with that spray bar are of identical structure and function.

The frequency pulses are capacitively coupled to a monostable 712 which is connected for one-shot operation. Capactive coupling enhances the reliability of the spray bar driver circuits as a failure in a monostable input will not affect the frequency on conductor 714 to the other nozzle driver monostables. Monostable 712 is sensitive only to the leading edge of the frequency pulses, and potentiometer R34 provides adjustable control over the output pulse width of the monostable, irrespective of the pulse width appearing on conductor 714. Thus, on the output conductor 716 of the monostable 712 appear electrical pulses which are controllable both as to frequency and pulse width. The actual knob 50 (FIG. 1) for controlling the pulse duration includes calibrated markings for indicating various pulse widths. An additional potentiometer R36 is provided to calibrate the output pulse width on conductor 716 to match the indication as shown on the knob dial 50. Darlington connected transistor Q8 ad Q9 drive an indication LED 718 in accordance with the pulse width and frequency with which the respective nozzle is driven.

Additional overall control of each solenid spray nozzle is had by the provision of a switch 720 which, when closed, supplies DC power to its respective nozzle driving circuit. The monostable output pulse on conductor 716 respectively operates its respective nozzle solenoid 722 in accordance with the frequency established by the master control unit 44, as well as the duration established by the respective monostable 712. Transistor Q10 is of the power type capable of switching inductive currents necessary for driving the nozzle solenoid 722. Diode 724 connected across the solenoid reduces the kick-back transients generated when the solenoid current is removed on transistor Q10 turn-off.

Within each spray bar control unit 48 there is a manually activated purge generator for momentarily increasing the frequency with which each spray nozzle within that control bar is driven. Monostable 726 provides a single output pule of 2–6 seconds in duration as adjusted by potentiometer R38. The monostable is manually triggered by the momentary push button 728. The resulting output pulse on conductor 730 deactivates the frequency pulses on conductor 714 by turning on transistor Q12 which turns off transistor Q7. The frequency pulses on conductor 714 are deactivated only for the duration of the pulse generated by monostable 726. The monostable output pulse, which is a positive-going signal, enables one input of AND gate 732, and enables the high frequency purge pulses on the other input (as generated by astable monostable 734) to be coupled to transistor Q14. Transistor Q14 inverts the purge pulses and drives conductor 714 which was previously deactivated through transistor Q7. The inversion of the high frequency purge pulses by transistor Q14 is of no consequence as astable multivibrator 734 is connected to generate fifty percent duty cycle pulses with a frequency of 2–5 hertz and adjustable by potentiometer R40.

After monostable 726 times out, AND gate 732 prevents the purge pulses being coupled to transistor Q14, and transistor Q12 becomes cut off thereby permitting transistor Q7 to again couple present frequency pulses to counductor 714 and thus to the individual spray nozzle circuits.

With the foregoing arrangement there is provided a great deal of flexibility to a press operator who can initiate a purge cycle to a particular spray bar. One can also individually adjust each nozzle to optimize spray dampening according to the density of print passing through that spray zone, or the operator can completely remove a spray nozzle from operation should it fail or should no printing exist within its spray zone.

Auxiliary Frequency Generator

Figure 8:
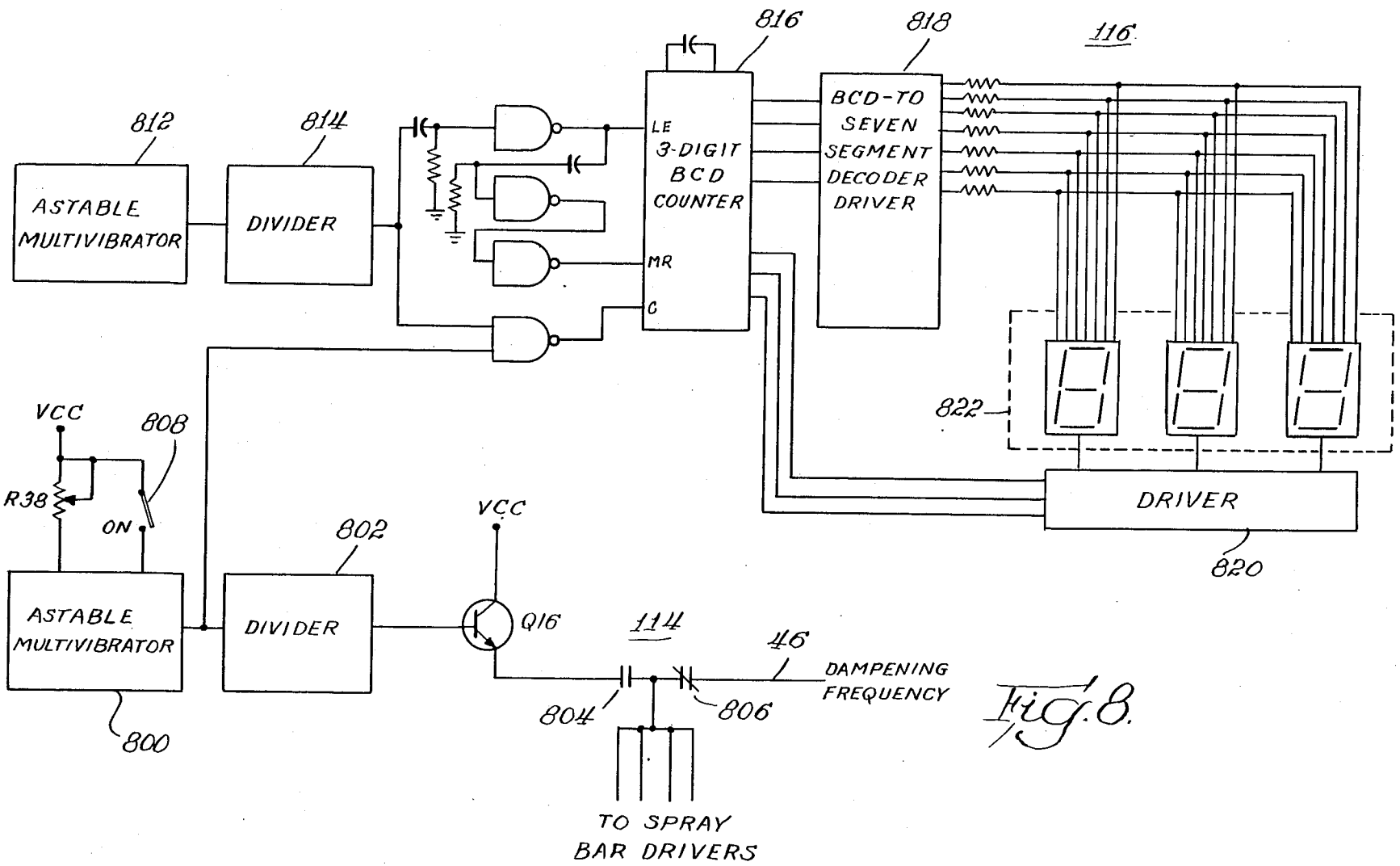
FIG. 8 is an electrical drawing of the auxiliary frequency generator which can be manually substituted for the multifrequency pulse generator in the event of the failure of the latter.

With regard to FIG. 8 there is shown the back-up frequency generator which is manually operable to supply spray dampening frequencies in substitute of the master control unit 44 in the event of the failure of the latter. Shown in FIG. 8 is an auxiliary frequency generator 112 which is switchable to the dampening frequency bus 46, and adjustable to a desired frequency as observed on a numeric frequency display 116. The auxiliary frequency generator 112 is comprised of a monostable connected to operate in an astable mode. Because of electronic component considerations, the multivibrator 800 operates at a frequency higher than desired, but is subsequently divided down by divider 802 to the desired frequency range, comprising approximately zero to five hertz. A frequency control potentiometer R38 is provided to manually adjust the pulse frequency according to the scheme shown in FIG. 5. Transistor Q16 is of the power type capable of coupling the frequency pulses from the divider 802 to the dampening signal bus 46, and thus the plurality of spray bar control units. A manual switch (not shown) is operable to operate normally closed contacts 806 and normally open contacts 804 to couple the frequency pulses from the emitter of transistor Q16 to the plurality of spray bar control units. The spray dampening signal bus 46, and thus the master control unit 44, are effectively removed from the spray bar control units. Switch 808 is also manually operable to supply power to the astable multivibrator 800 to commence oscillating.

Output 810 of astable monostable 800 is also connected to the numeric frequency display circuit 116. This display circuit is equivalent to that discussed in connection with FIG. 3*c* and thus will not be discussed in great detail. Briefly described, an astable multivibrator 812 generates a frequency which is divided down by divider 814 to provide a clock signal to the three-digit BDC counter 816. Counter 816 generates BCD information for the decoder driver 818, as well as multiplexing information for the display drivers 820. In a timed relationship consonant with standard multiplexing techniques, the drivers sequentially drive each digit according to the information then present on the output of the decoder driver 116. The operator, in adjusting the frequency of the astable multivibrator 800, is then able to select the appropriate frequency in accordance with the speed of the press.

As demonstrated by the foregoing preferred embodiment, the invention disclosed herein provides a means for controlling the amount of dampening fluid applied through solenoid-controlled nozzles by electrically controlling the nozzles in accordance with the speed of the press. The speed of the press is accurately measured and therefrom a frequency is generated to control the repetitive pulsing of the spray nozzles. As the speed of the press increases, the frequency or pulse rate also increases, but not necessarily in a linear relationship. By experience it has been found that a nonlinear relationship optimizes the dampening process and thereby provides a high quality print, as well as less wasted dampening fluid.

Since various modifications to the system described herein are undoubtedly possible by those skilled in the art without departing from the scope and spirit of the invention, such as implementing the system functions by microprocessor means, the detailed description is to be considered illustrative and not restrictive of the invention as claimed hereinbelow.

What is claimed is:

1. In a spray dampening system for delivering a dampening fluid through a bank of solenoid-operated spray nozzles to a moving surface of a printing operation, a control system for operating said solenoids comprising:

means responsive to the speed of said printing operation for producing a voltage representation of said speed;

a pulse generator for producing pulses at a plurality of predetermined disparate frequencies simultaneously;

selector means responsive to said voltage for selecting one pulse frequency of said plurality of simultaneously produced predetermined disparate frequencies based upon the voltage level of said voltage; and a drive circuit with an input operatively connected to said selector means for an output for driving said solenoid-operated spray nozzles at said selected predetermined frequency, whereby the spray nozzles will be operated at the selected predetermined frequency with the selection of the frequency being determined by the speed of the printing operation.

2. The spray dampening system of claim 1 wherein said pulse generator is comprised of a plurality of generators each producing a predetermined fixed frequency, and wherein said selector means includes priority means for selecting one frequency of at least two frequencies in contention for selecting by said priority means.

3. The spray dampening system of claim 2 wherein said priority means includes means for selecting the highest frequency of said contending frequencies.

4. The spray dampening system of claim 1 wherein said selector means includes a translator means having an input connected to said analog voltage, and a plurality of outputs with not more than two of which are active at one time and representative of said analog voltage, and said active outputs being operative to enable said selector means to select one frequency of said plurality of frequencies.

5. The spray dampening system of claim 4 further including a dot graph display driven by the outputs of said translator means.

6. The spray dampening system of claim 1 wherein said means for producing an analog voltage includes transducer means having a first converter means for converting the rotational speed of said roller into pulses of frequencies corresponding to press speeds, and a second converter means for converting each frequency of said pulses of frequencies into a representative analog voltage.

7. The spray dampening system of claim 6 further including means for converting said pulses of frequencies into contact width pulses.

8. The spray dampening system of claim 1 further including override means for overriding the frequency selected by said selector means and for driving said driver circuit with a frequency nonrepresentative of the said press speed.

9. The spray dampening system of claim 8 further including means for automatically activating said override means at low press speeds.

10. The spray dampening system of claim 1 further including an auxiliary pulse generator with a manually variable frequency, and means for disabling the frequency selected by said selector means and inserting therefor the frequency from said auxiliary pulse generator.

11. The spray dampening system of claim 1 wherein said driver circuit further includes means for varying the width of the output pulse applied by the driver circuit to the solenoid operated spray nozzles, thereby permitting regulation of the duration each spray nozzle is on during each pulse.

12. In a printing operation, a spray dampening system for applying dampening fluid to a moving surface through solenoid-operated spray nozzles, comprising:

sensor means for sensing the speed of said printing operation and producing an analog output voltage level representative of said speed;

translator means having an input coupled to said analog voltage for translating each analog voltage level into an equivalent output digital indication of said press speed;

a multifrequency pulse generator adapted for generating a plurality of pulse frequencies and wherein ones of said frequencies are nonlinearly related to others of said frequencies;

selector means with an input coupled to the output digital indication of said translator means for selecting one frequency of said multifrequency pulse generator based upon said digital indication; and driver means for driving said solenoid-operated spray nozzles with the selected frequency of said multifrequency generator.

13. The spray dampening system of claim 12 further including visual display means coupled to said selector means for displaying an indication of the press speed.

14. The spray dampening system of claim 12 wherein said multifrequency pulse generator is comprised of a plurality of astable pulse generator each one generating a fixed pulse frequency.

15. The spray dampening system of claim 14 wherein the frequency generated by each astable pulse generator is different, and each frequency within the range of frequencies collectively generated increases from one astable generator to the next astable generator by nonlinear increments, whereby a sequential ascending selection of frequencies produces frequencies increasing in a nonlinear manner.

16. The spray dampening system of claim 14, wherein said selector means includes a plurality of logic circuits each responsive to said translator means, and each associated with a different astable pulse generator and operative to enable and thus select the frequency of the astable generator associated therewith.

17. The spray dampening system of claim 12 wherein said translator means comprises a dot graph display driver integrated circuit.

18. The spray dampening system of claim 17 further including a dot graph display driven by an output digital indication of said translator means.

19. The spray dampening system of claim 17 wherein said selector means includes means for selecting two frequencies of said plurality of frequencies, and further including visual numeric display means for providing a numerical indication of each of the two frequencies selected.

20. The spray dampening system of claim 12 wherein said means includes a tachometer generator for generating an output voltage of magnitude representative of the press speed.

21. The spray dampening system of claim 12 wherein said sensor means includes:

means for generating a frequency representative of the press speed; and frequency-to-voltage converter means coupled to said speed sensing means for converting said frequency into an equivalent voltage level.

22. In a printing operation, a spray dampening system for applying dampening fluid through solenoid-operated spray nozzles to a moving surface, comprising:

a master control unit including multifrequency generator means for generating an electrical pulse train with a frequency representation of the speed of said printing operation;

a plurality of spray bars each with a plurality of solenoid-operated spray nozzles and each said spray bar being operative to apply dampening fluid to a respective moving surface;

a plurality of spray bar drivers electrically coupled to said master control unit so that said electrical pulse train may be applied to said drivers, and each of said drivers may pulse the nozzle solenoid of a respective one or more of the said plurality of spray nozzles at said frequency;

each said spray bar driver including a plurality of pulse current drivers each one for driving a different one of said plurality of solenoid-operated spray nozzles with said pulse train, and each said pulse current driver including means for varying the width of each pulse of said pulse train independently of said frequency and of the width the pulse train pulses applied by the other pulse current drivers, whereby as the speed of said printing operation increases, the frequency at which said spray nozzles are pulsed is increased thereby increasing the amount of dampening fluid applied to each said surface.

23. The spray dampening system of claim 22 wherein each pulse current driver includes a monostable multivibrator with an input connected to said pulse train, and means for varying the width of each pulse of said pulse train at the output of said multivibrator.

24. The spray dampening system of claim 23 wherein each monostable multivibrator is capacitively coupled to said means for generating a pulse train.

25. The spray dampening system of claim 22 further including electrical isolation means for electrically isolating said master control unit from each spray bar driver.

26. The spray dampening system of claim 25 wherein each spray bar driver includes electrical isolation means for electrically isolating itself from other spray bar drivers.

27. The spray dampening system of claim 22 wherein said master control unit further includes:

an auxiliary frequency pulse generator;

manual means for adjusting the output frequency of said generator; and switching means for substituting the output frequency of said pulse generator for the pulse train of said multifrequency generator means.

28. In a printing operation, a spray dampening system for applying dampening fluid through solenoid-operated spray nozzles to a moving surface, comprising:

a master control unit including multifrequency generator means for generating an electrical pulse train with a frequency representative of the speed of said printing operation;

a plurality of spray bars each with a plurality of solenoid-operated spray nozzles and each said spray bar being operative to apply dampening fluid to a respective moving surface;

a plurality of spray bar drivers electrically coupled to said master control unit so that said electrical pulse train may be applied to said drivers and each of said drivers may electrically pulse the nozzle solenoids of a respective one of said spray bars at said pulse train frequency, whereby as the speed of said printing operation increases the frequency at which said spray nozzle solenoids are pulsed is increased thereby increasing the amount of dampening fluid applied to said moving surface;

said master control unit including means responsive to an indication of the speed of said printing operation for sensing press speeds at a predetermined level during increasing speeds and decreasing speeds and for preventing the electrical pulses from being applied to said spray bar drivers and thereby prevent spraying when the press speed is below said predetermined level.

29. The spray dampening system of claim 28 and further including purge means for preventing said pulse train, for a predetermined period of time, from being coupled to ones of said plurality of spray bars when said press speed reaches said predetermined speed, and for substituting for said pulse train a series of electrical pulses, during said predetermined period of time, of frequency nonrepresentative of said press speed.

30. The spray dampening system of claim 29 wherein the series of electrical pulses substituted by said purge means is operative to cause an increased amount of dampening fluid to be applied by said ones of said plurality of spray bars.

* * * * *